US006789386B1

(12) United States Patent
Haerle

(10) Patent No.: US 6,789,386 B1
(45) Date of Patent: Sep. 14, 2004

(54) EXHAUST GAS MANIFOLD

(76) Inventor: Hans A. Haerle, Roettinger Strasse 38, D-73441 Bopfingen (DE)

( * ) Notice: Subject to any disclaimer, the term of this patent is extended or adjusted under 35 U.S.C. 154(b) by 0 days.

(21) Appl. No.: 10/048,273

(22) PCT Filed: Jul. 5, 2000

(86) PCT No.: PCT/EP00/06285

§ 371 (c)(1),
(2), (4) Date: Jan. 28, 2002

(87) PCT Pub. No.: WO01/11209

PCT Pub. Date: Feb. 15, 2001

(30) Foreign Application Priority Data

Aug. 5, 1999 (DE) ..... 199 36 878
Jan. 14, 2000 (DE) ..... 100 01 287

(51) Int. Cl.[7] ..... F01N 7/10
(52) U.S. Cl. ..... 60/323; 60/302; 277/591; 277/601
(58) Field of Search ..... 60/322, 323, 302; 277/591, 592, 593, 595, 600, 601

(56) References Cited

U.S. PATENT DOCUMENTS

| | | | | | |
|---|---|---|---|---|---|
| 4,214,444 | A | | 7/1980 | Fujioka et al. | 60/322 |
| 4,390,185 | A | * | 6/1983 | Nicholson | 277/595 |
| 4,537,027 | A | | 8/1985 | Harwood et al. | 60/323 |
| 5,566,548 | A | * | 10/1996 | Khurana | 60/323 |
| 5,636,515 | A | * | 6/1997 | Matsumoto et al. | 60/323 |
| 5,682,741 | A | * | 11/1997 | Augustin et al. | 60/323 |
| 5,692,373 | A | * | 12/1997 | Atmur et al. | 60/323 |
| 6,254,142 | B1 | | 7/2001 | Kaifel et al. | 60/323 |
| 6,327,854 | B1 | * | 12/2001 | Bonny et al. | 60/323 |

FOREIGN PATENT DOCUMENTS

| | | | |
|---|---|---|---|
| DE | 295 05 660.6 | 7/1995 | F01N/7/08 |
| EP | 0 220 371 A1 | 5/1987 | F01N/7/10 |
| EP | 0 671 551 A1 | 9/1995 | F01N/7/10 |
| EP | 0 709 557 A1 | 5/1996 | F01N/7/10 |
| EP | 0 765 994 A1 | 4/1997 | F01N/7/10 |
| EP | 0 861 975 A2 | 2/1998 | F01N/7/10 |
| WO | 99/11911 | 3/1999 | F01N/3/28 |

* cited by examiner

*Primary Examiner*—Thomas Denion
*Assistant Examiner*—Tu M. Nguyen
(74) *Attorney, Agent, or Firm*—Davis & Bujold PLLC

(57) ABSTRACT

An exhaust gas manifold for mounting on a cylinder head of an internal combustion engine, composed of at least one cylinder support having bores for evacuating the exhaust gas. The exhaust gas manifold comprises an exhaust gas manifold collector housing (9) for collecting exhaust gas from the cylinder head, and a sealing device (10) placed between the exhaust gas collector housing (9) and the cylinder head (2). The exhaust gas manifold collector housing (9) is provided with recesses (12) so that it can be directly connected to the cylinder head (2) via a fixation mechanism (18), whereby the effect of heat enables movements between the exhaust gas manifold collector housing (9) and the cylinder head (2).

16 Claims, 7 Drawing Sheets

EXHAUST GAS MANIFOLD

FIELD OF THE INVENTION

The invention relates to an exhaust manifold for mounting on a cylinder head of an internal combustion engine.

BACKGROUND OF THE INVENTION

In EP 0 709 557 A1, an exhaust-tube manifold is described in a design as used in very many internal combustion engines. Each exhaust tube is welded to a flange which is then screwed onto the cylinder head of the internal combustion engine. The exhaust tubes open in a known manner into a collector tube, which continues into an exhaust pipe.

Known exhaust manifolds of this type are disadvantageously very heavy and expensive and have the further disadvantage that because of their large mass they take away very large amounts of heat from the exhaust gas passed into them. This reduces the temperature of the exhaust gas, which has the effect that the catalytic converter arranged in the exhaust pipe has very poor efficiency, particularly during starting of the internal combustion engine.

In order to improve the efficiency and the light-off performance of the catalytic converter, according to one prior art which is known from practice, exhaust manifolds having "air gap insulation" have been developed, in which a housing and a gas-conducting pipe arranged in the housing are provided.

Even here, however, the relatively high mass and, in particular, the high outlay on welding work for assembling the housing surrounding the inner gas-conducting pipe and for mounting this housing on a cylinder head flange remain disadvantageous, since both contribute to increasing the costs of exhaust manifolds of this type. The required tightness of the exhaust manifold means that in the case of the known constructions, welding work of this type may not, however, be omitted.

It is, therefore, the object of the present invention to provide an exhaust manifold for mounting on a cylinder head of an internal combustion engine, said exhaust manifold being simple and cost-effective to produce, having a low mass and being able to be mounted on the cylinder head of the internal combustion engine in a simple manner.

According to the invention, this object is achieved by the features mentioned in claim 1.

DETAILED DESCRIPTION OF THE INVENTION

The exhaust manifold according to the invention can be connected directly to the cylinder head by suitable fastening means, for example screws. In order to achieve a seal between the exhaust-gas collector housing and the cylinder head, just one sealing device is necessary between the exhaust-gas collector housing and the cylinder head, and costly welding work can be omitted.

The exhaust-gas collector housing can advantageously expand with respect to the cylinder head and can execute a corresponding movement, with the result that costly constructions having sliding flanges or the like can be avoided.

One particular advantage of the exhaust manifold according to the invention is the low degree of deformation required, as a result of which very thin metal plates having a correspondingly low mass can be used. This leads to very low material and production costs and to an extremely small amount of heat being removed from the exhaust gas. Furthermore, the exhaust manifold according to the invention has the advantage of requiring a relatively small amount of space in the engine compartment of a motor vehicle.

If, in one advantageous development of the invention, a flange is arranged between the exhaust-gas collector housing and the cylinder head, then an even better sliding movement of the exhaust-gas collector housing with respect to the cylinder head is possible on account of said housing possibly undergoing thermal expansion. In addition, this advantageously enables the cylinder head to be uncoupled from the exhaust-gas collector housing.

In a further advantageous refinement of the invention, a gas-conducting channel can be arranged in the exhaust-gas collector housing. This produces an exhaust manifold having air gap insulation, which exhaust manifold removes relatively little heat from the exhaust gas owing to the thin walls of the gas-conducting channel and the air gap between the exhaust-gas collector housing and the gas-conducting channel. This prevents the exhaust-gas temperature from dropping and results in better light-off performance and efficiency of a catalytic converter arranged in the exhaust pipe adjoining the exhaust manifold.

Furthermore, when a gas-conducting channel is used, an exhaust-gas collector housing consisting of cost-effective structural steel which can easily be deformed is advantageously used, since said housing is thermally less severely stressed.

Also in this embodiment, a flange can be arranged between the exhaust-gas collector housing and the cylinder head, which flange permits the better sliding movement of the exhaust-gas collector housing with respect to the cylinder head.

In the case of all of the embodiments, a low degree of deformation arises, which leads advantageously to thin metal plates and therefore to the individual components having very small masses.

In a further advantageously embodiment of the invention, provision can be made for the gas-conducting channel to be provided, on its side facing the cylinder head, with a circumferential collar which, in the assembled state, is at least indirectly wedged between the exhaust-gas collector housing and the sealing device, movements caused by the effect of heat being possible between the gas-conducting channel and the sealing device.

This results in a very simple fastening of the gas-conducting channel, but displacement thereof in the plane of the cylinder head remaining possible, however, and, at the same time, movement thereof perpendicularly with respect to this plane and clattering possibly caused thereby being prevented.

BRIEF DESCRIPTION OF THE DRAWINGS

The invention will now be described, by way of example, with reference to the accompanying drawings in which.

Further advantageously refinements and developments of the invention emerge from the remaining subclaims and from the exemplary embodiment illustrated in principle below with reference to the drawing. In the drawing:

DETAILED DESCRIPTION OF THE INVENTION

Figure 1:
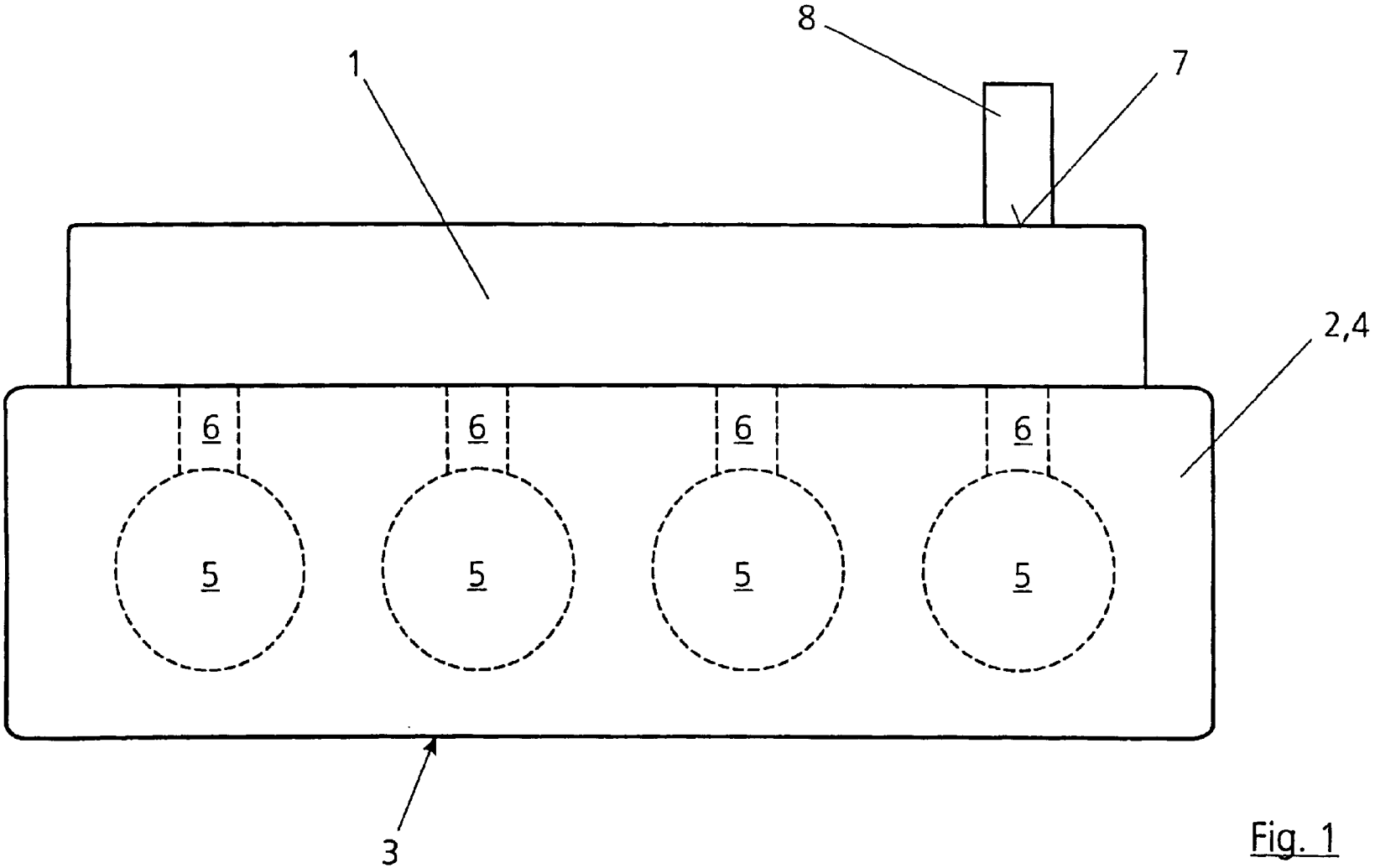
FIG. 1 shows a highly schematized internal combustion engine with an exhaust manifold mounted thereon.

FIG. 1 shows an exhaust manifold 1 which is mounted on a cylinder head 2 of an internal combustion engine 3. The present embodiment concerns an internal combustion engine 3 of series construction, in which the cylinder head 2 has just one cylinder bank 4 with four cylinders 5 in this case. In the case of internal combustion engines 3 of V-type construction, a plurality of cylinder banks 4 could, of course, be provided and the exhaust manifold 1 would then be mounted in each case on them. Situated in the cylinder head 2 are a plurality of exhaust-gas bores 6 which lead away from the cylinders 5 and open into the exhaust manifold 1, as a result of which the exhaust gas passes into the exhaust manifold 1. The exhaust manifold 1 is provided, on its side facing away from the internal combustion engine 3, with an opening 7, which can be situated at any desired location and into which an exhaust pipe 8 is inserted in a known manner. A catalytic converter (not illustrated) used for cleaning the exhaust gases can be situated in the exhaust pipe 8.

In FIGS. 2 to 6, the exhaust manifold 1 is illustrated by means of exploded drawings, in each case in different embodiments.

Figure 2:
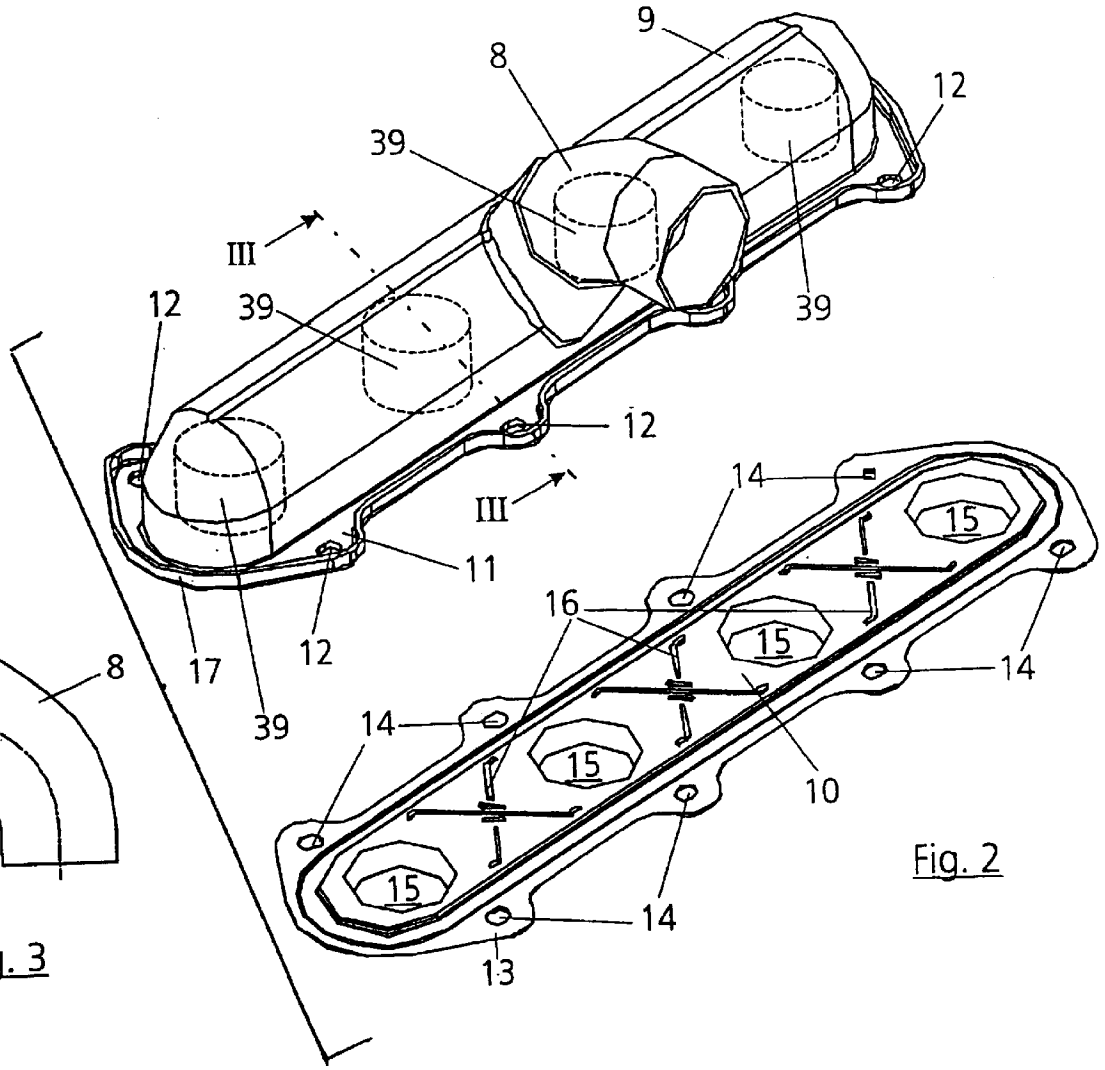
FIG. 2 shows an exploded illustration of the exhaust manifold from FIG. 1 in a first embodiment.

The exhaust manifold 1 according to FIG. 2 comprises an exhaust-gas collector housing 9, which receives the exhaust gases from all of the exhaust-gas bores 6 of a cylinder bank 4, and a sealing device 10. The exhaust gases can leave the exhaust-gas collector housing 9 again through the opening 7, which is situated on that side of the housing which faces away from the cylinder head 2, and can, therefore, enter into the exhaust pipe 8. The exhaust-gas collector housing 9 is surrounded on its entire circumference by a collar 11 in which are situated recesses 12 for the passage of fastening means (not illustrated in FIG. 2), such as screws, for example. The fastening means are used to mount the exhaust-gas collector housing 9 on the cylinder head 2.

The sealing device 10 corresponds in its shape to that side of the exhaust-gas collector housing 9 which faces the cylinder head 2, runs over the entire region between the exhaust-gas collector housing 9 and the cylinder head 2 and accordingly likewise has a collar 13 having recesses 14, the positions of which at least approximately correspond with the positions of the recesses 12 in the collar 11 of the exhaust-gas collector housing 9.

Furthermore, the sealing device 10 has a plurality of bores 15, the number of which and positions of which at least approximately correspond with the positions of the exhaust-gas bores 6 in the cylinder head 2, in order to ensure that the exhaust gas flows out of the exhaust-gas bores 6 into the exhaust-gas collector housing 9. On its side facing the exhaust-gas collector housing 9, the sealing device 10 is provided with beads or impressions 16 which produce a gap between the cylinder head 2 and the sealing device 10. The sealing device 10 may, for example, be constructed from a metallic material.

Furthermore, it can be gathered from FIG. 2 that the exhaust-gas collector housing 9 has a beading 17 on its outside. This beading 17 bounds the collar 11 of the exhaust-gas collector housing 9 to the outside and increases the strength of the exhaust-gas collector housing 9. In the present embodiment, the exhaust-gas collector housing 9 consists of a material with high temperature stability, and is able to execute small movements with respect to the sealing device 10 and therefore with respect to the cylinder head 2, which movements are caused by the introduction of heat by the exhaust gas and the associated expansion of the exhaust-gas collector housing 9.

It would also be possible to produce the exhaust-gas collector housing 9 from multi-layered metal plates in a sandwich-type construction, as a result of which the radiation of sound could be reduced. In the case of a sandwich-type construction of this type, one layer could, for example, consist of steel and the other layer of aluminum, in which case the production of exhaust-gas collector housings 9 which withstand high temperatures would also be possible.

In order to be able to clean the exhaust gas in a simple manner, a plurality of individual catalytic converter elements 39 are arranged in the exhaust-gas collector housing 9. In this arrangement, each catalytic converter element 39 is assigned to an exhaust-gas bore 6 or to a cylinder 5, with the result that in all of the exemplary embodiments four catalytic converter elements 39 are provided. The catalytic converter elements 39, which comprise, for example, a wrap-around plate which is known per se, are of cylindrical design and can be arranged standing or lying. In the exhaust-gas collector housing 9, the catalytic converter elements 39 are held by knitted wire fabric elements, which are not illustrated. As an alternative to this, the use of a conventional catalytic converter in the exhaust pipe 8 is of course also possible, as already mentioned above.

Figure 3:
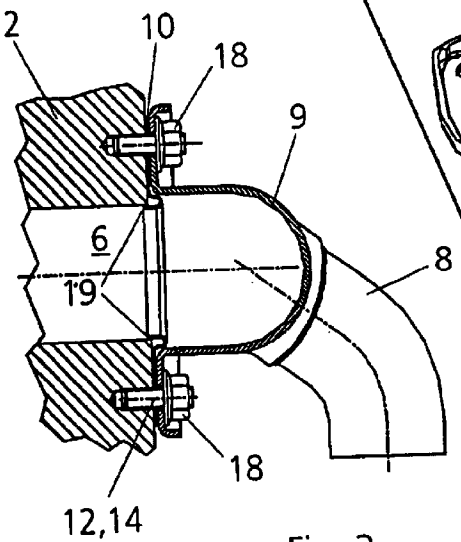
FIG. 3 shows a section according to the line III—III from FIG. 2.

In FIG. 3, the abovementioned fastening means which are designed as screws 18 and are intended for mounting the exhaust-gas collector housing 9 on the cylinder head 2 are illustrated. Said fastening means are passed through the recesses 12 in the exhaust-gas collector housing 9 and the recesses 14 in the sealing device 10. Appropriate tightening of the screws 18 enables the displacability specified above of the exhaust-gas collector housing 9 with respect to the cylinder head 2 to be set. However, in this case tightness of the exhaust manifold 1 is ensured at all times. Furthermore, it can be seen that the bores 15 of the sealing device 10 are provided with beadings 19 which reach into the exhaust-gas bores 6 of the cylinder head 2.

Figure 4:
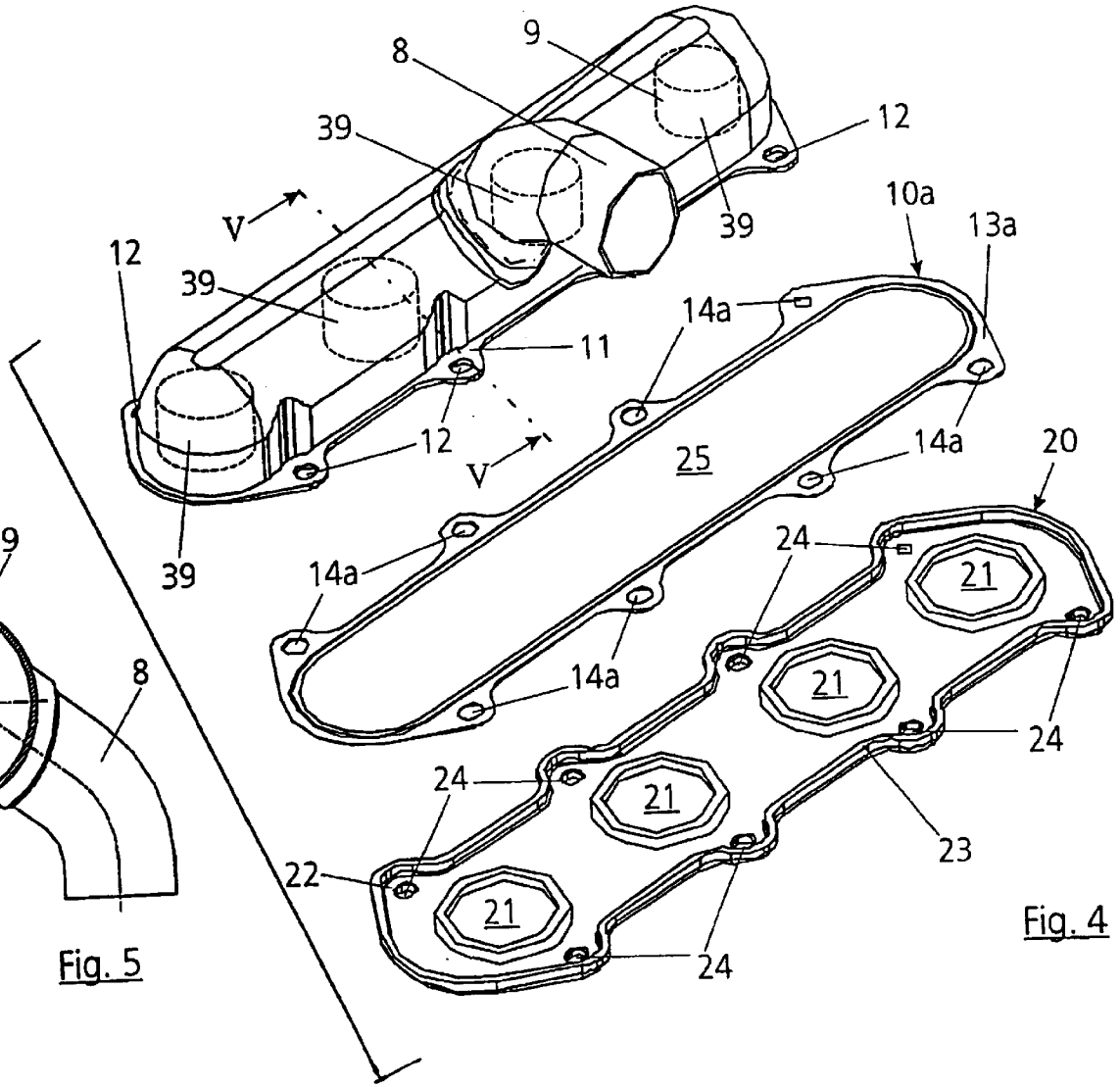
FIG. 4 shows an exploded illustration of the exhaust manifold from FIG. 1 in a second embodiment.

FIG. 4 shows a further embodiment of the exhaust manifold 1, in which again the exhaust-gas collector housing 9 and the sealing device 10 are provided, but in addition a flange 20 and a further sealing device 10*a* are provided, in order to form the exhaust manifold 1. In the illustration according to FIG. 4, only the sealing device 10*a* can be seen. The flange 20 is provided with bores 21, the number and positions of which at least approximately correspond with the positions of the exhaust-gas bores 6 in the cylinder head 2. In this case, the bores 21 are of round design. Furthermore, the flange 20 has a circumferential collar 22 and a beading 23, recesses 24 being placed in the collar 22, the positions of which recesses correspond with the positions of the recesses 12 in the exhaust-gas collector housing 9.

In this case, the sealing device 10*a* does not have any bores 15 corresponding to the exhaust-gas bores 6; rather, it has a recess 25 which runs over approximately the entire length and over approximately the entire width of the sealing device 10*a*. However, in the manner according to FIG. 2, the sealing device 10*a* is again provided with a collar 13*a* and recesses 14*a*. On account of the large recess 25, the sealing is undertaken merely by the collar 13*a* of the sealing device 10*a*.

Figure 5:
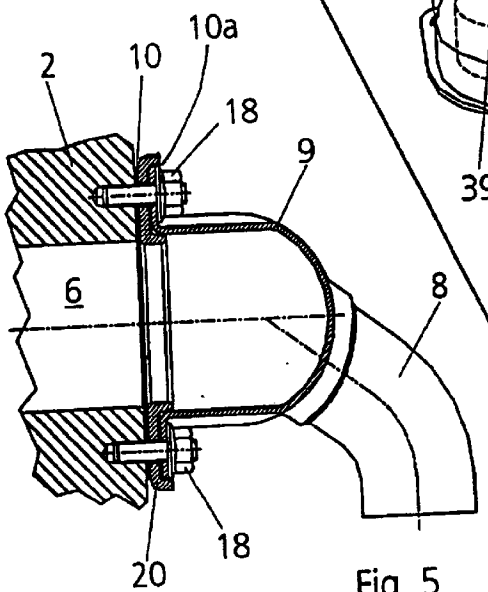
FIG. 5 shows a section according to the line V—V from FIG. 4.

In FIG. 5, the mounting of the exhaust manifold 1 on the cylinder head 2 is illustrated in section. It can be seen here that the sealing device 10*a* is arranged between the flange 20 and the exhaust-gas collector housing 9. The further sealing device 10 is situated between the cylinder head 2 and the exhaust-gas collector housing 9, but in contrast with FIG. 2 and FIG. 3 it is designed without impressions 16 and without beadings 17. It is also revealed in this Figure that the inner contour of the beading 23 of the flange 20 corresponds with the outer contour of the collar 11 surrounding the exhaust-gas collector housing 9, with the result that the exhaust-gas collector housing 9 finds space within the beading 23 of the flange 20. In this case, however, the exhaust-gas collector housing 9 does not have any beading 17. The exhaust-gas collector housing 9 can be preassembled by means of embossings or spot welds.

Here too, again, movements caused by the effect of heat are possible between the exhaust-gas collector housing 9 and the flange 20, specifically on account of the sealing device 10*a* mounted between them. As previously, the fastening devices 18 are passed through the recesses 12 in the exhaust-gas collector housing 9, the recesses 24 in the flange 20 and the recesses 14 and 14*a* in the sealing devices 10 and 10*a* for the purpose of mounting the exhaust manifold 1 on the cylinder head 2.

Figures 6, 7:
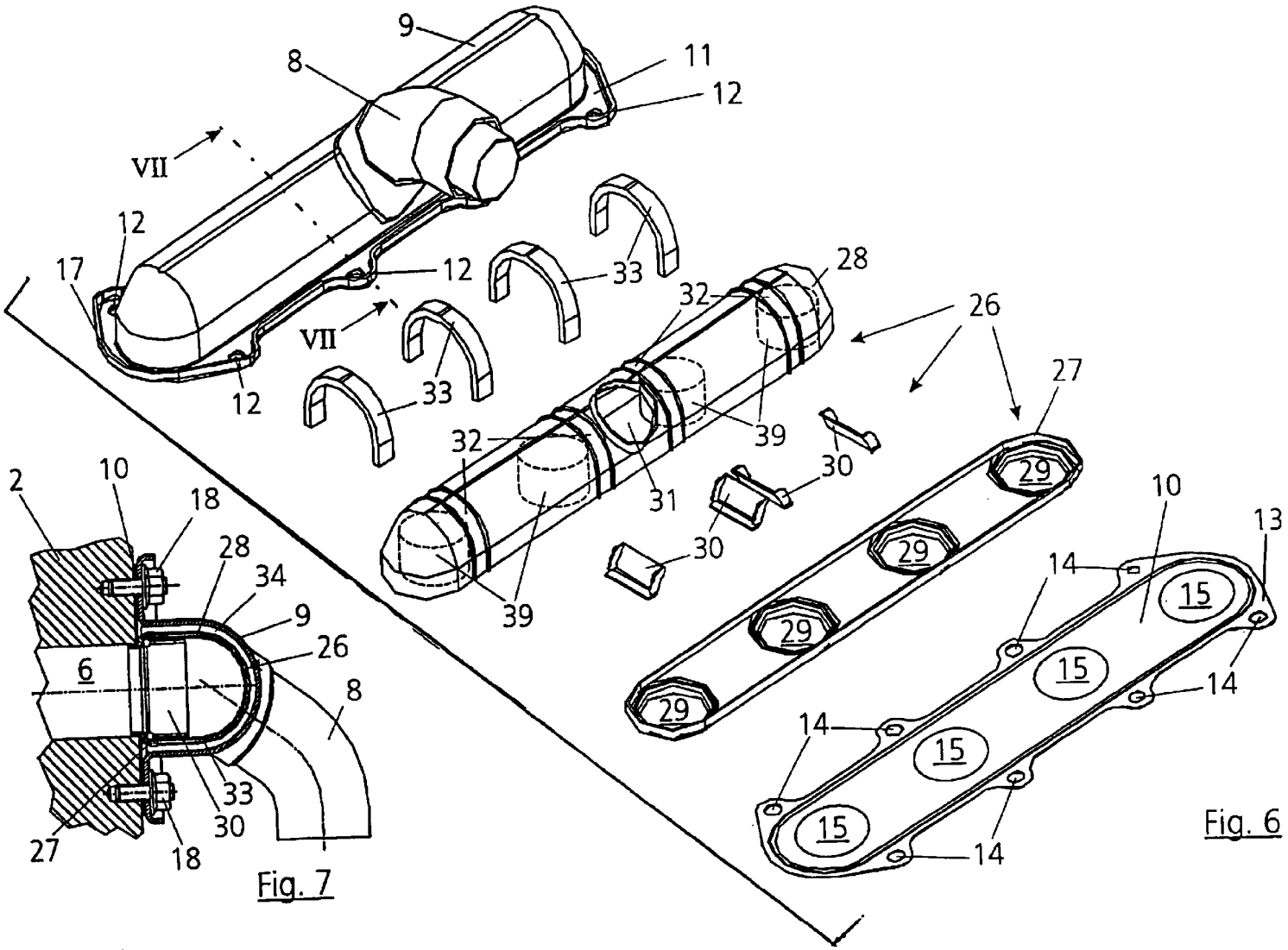
FIG. 6 shows an exploded illustration of the exhaust manifold from FIG. 1 in a third embodiment.
FIG. 7 shows a section according to the line VII—VII from FIG. 6.

FIG. 6 shows a further embodiment of the exhaust manifold 1 which again has the exhaust-gas collector housing 9 and the sealing device 10. However, a gas-conducting channel 26 is arranged in the exhaust-gas collector housing 9, said gas-conducting channel being of two-part design with a bottom part 27 and a cover part 28. As previously, the exhaust-gas collector housing 9 is provided with the collar 11 and the recesses 12 situated therein, and also with the beading 17 which surrounds the collar 11. Likewise as described above, the sealing device 10 has the collar 13, the recesses 14 and the bores 15.

The bottom part 27 of the gas-conducting channel 26, which is produced from a material with high temperature stability, is provided with bores 29, the positions of which at least approximately correspond with the positions of the exhaust-gas bores 6 of the cylinder head 2. This enables the exhaust gas to pass into the gas-conducting channel 26. Baffle plates 30 are arranged within the gas-conducting channel 26, said baffle plates conducting the gas flow from the bores 29 to an opening 31 which leads to the exhaust pipe 8 and is situated in the cover part 28 of the gas-conducting channel 26. The baffle plates 30 can be welded either to the exhaust-gas collector housing 9 or the gas-conducting channel 26, or can be stamped out of the material of the bottom part 27 and/or the cover part 28 of the gas-conducting channel 26. During the installation of the exhaust manifold 1, retaining brackets 33, which are used for fastening the gas-conducting channel 26, are placed onto indentations 32 made on the outside of the cover part 28. In other words, the retaining brackets 33 are arranged in such a manner that when the exhaust-gas collector housing 9 is mounted on the cylinder head 2, the retaining brackets 33 secure the gas-conducting channel 26 by means of the fastening means 18. The tightness of the gas-conducting channel 26 is ensured by the bottom part 27 corresponding in a very precisely fitting manner with the cover part 28, and these two parts are locked tightly together by the force supplied by means of the retaining brackets 33. In addition, the bottom part 27 is also embossed with the cover part 28 or spot-welded thereto, with the result that complete pre-assembly is possible.

The retaining brackets 33, which are designed as resilient or damping elements, can consist of a material with high temperature stability, for example even of a knitted wire fabric with high temperature stability. This type of installation enables costly welding work to be omitted.

The abovementioned catalytic converter elements 39 for cleaning the exhaust gas can likewise be arranged in the gas-conducting channel 26, and can be held therein by knitted wire fabric elements (not illustrated).

As an alternative to the design which is illustrated, the gas-conducting channel 26 can also consist of a material which is permeable for fluids, in this case for exhaust gases. This can be achieved, for example, by a woven fabric or by a perforated plate. By this means, the mass of the gas-conducting channel 26 is reduced yet further, and the latter can thus remove less heat from the exhaust gas. Even in this embodiment, the exhaust gas nevertheless endeavors to flow in the direction of the opening 31, and only a very small part will pass through-the gas-conducting channel 26 to the exhaust-gas collector housing 9.

It can be seen in FIG. 7 that an air gap 34 is produced between the gas-conducting channel 26 and the exhaust-gas collector housing 9, said air gap isolating from the exhaust-gas collector housing 9 the exhaust gas flowing into the gas-conducting channel 26. By this means, the exhaust-gas collector housing 9 is heated only insignificantly and therefore removes comparatively little heat from the exhaust gas, which has the effect that the catalytic converter, which is situated in the exhaust pipe 8, has a better light-off performance and better efficiency on account of the relatively high exhaust-gas temperatures. Furthermore, this enables the exhaust-gas collector housing 9 to be produced from an inexpensive structural steel, if appropriate also from aluminized steel, since, as a rule, it does not come into contact with the exhaust gas. The sealing device 10 is mounted between the exhaust-gas collector housing 9 and the cylinder head 2.

In all of the designs in which it occurs, the air gap 34 may also be filled with sound-insulating materials, such as rock wool, ceramic wool, knitted wire fabric or individual wire pieces which are pressed together, in order to obtain appropriate sound insulation.

Figures 8, 9:
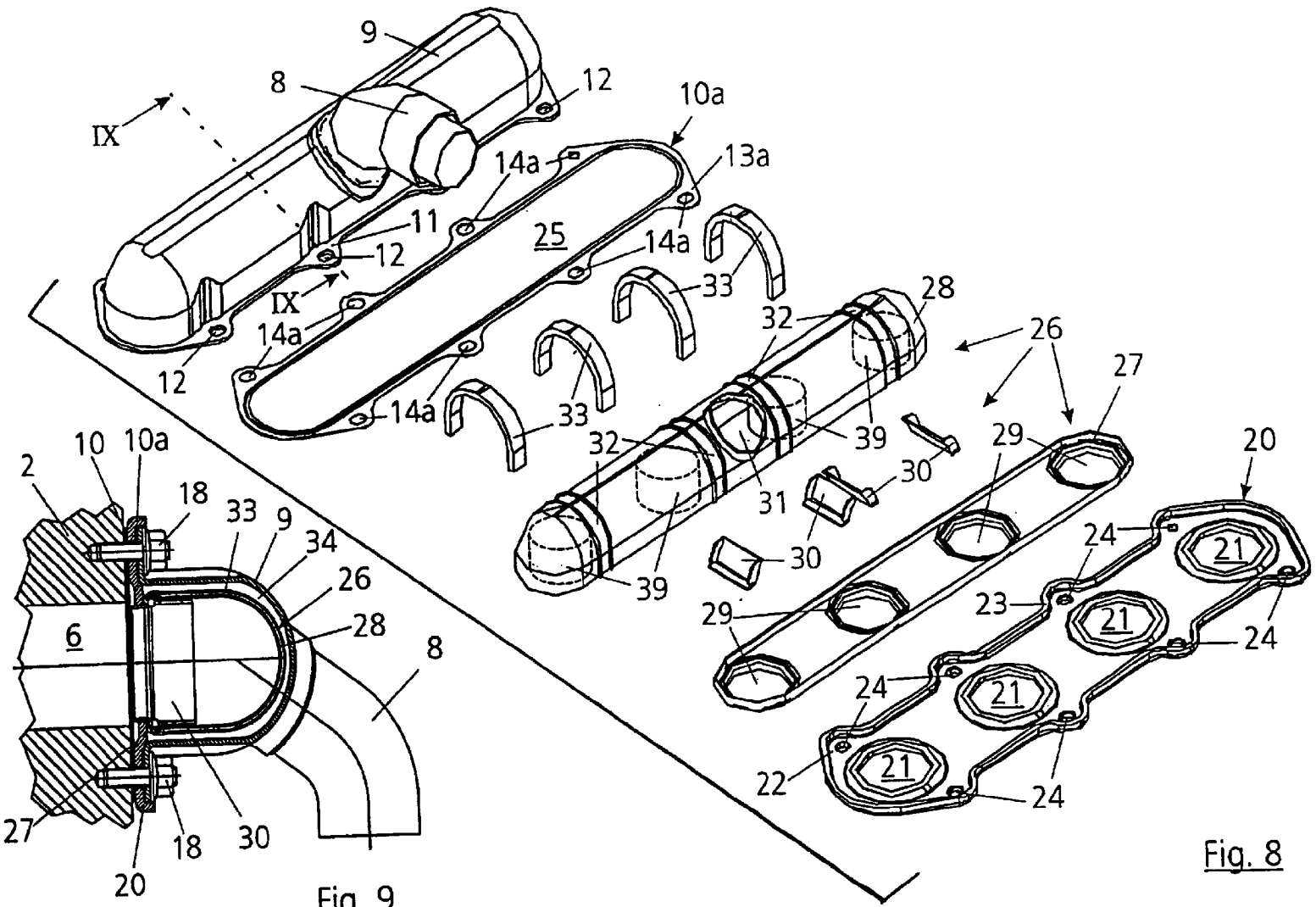
FIG. 8 shows an exploded illustration of the exhaust manifold from FIG. 1 in a fourth embodiment.
FIG. 9 shows a section according to the line IX—IX from FIG. 8.

FIG. 8 shows an embodiment of the exhaust manifold 1, which approximately corresponds with the embodiment according to FIG. 6. In contrast thereto, in FIG. 8 the flange 20, which is of very similar design to the flange 20 according to FIG. 4, is provided below the bottom part 27 of the gas-conducting channel 26. However, the bores 21 in said flange are of oval design, i.e. the diameter of the bores 21 is larger in the longitudinal direction of the flange 20 than the diameter of the bores 21 in the transverse direction of the flange 20. This makes possible a displacement or expansion movement of the gas-conducting channel 26 within the bores 21 on account of thermal expansion caused by the exhaust-gas temperatures. On account of the exhaust-gas collector housing 9 being accommodated in the flange 20 in a similar manner to FIG. 4, the exhaust-gas collector housing 9 is not provided with the beading 17, but merely has the collar 11.

It can be seen in FIG. 9 that the sealing device 10*a* is again used between the flange 20 and the exhaust-gas collector housing 9 and the sealing device 10 is used between the exhaust-gas collector housing 9 and the cylinder head 2. Here too, the retaining brackets 33 and the baffle plates 30 are provided as in FIG. 6 and FIG. 7.

Figure 10:
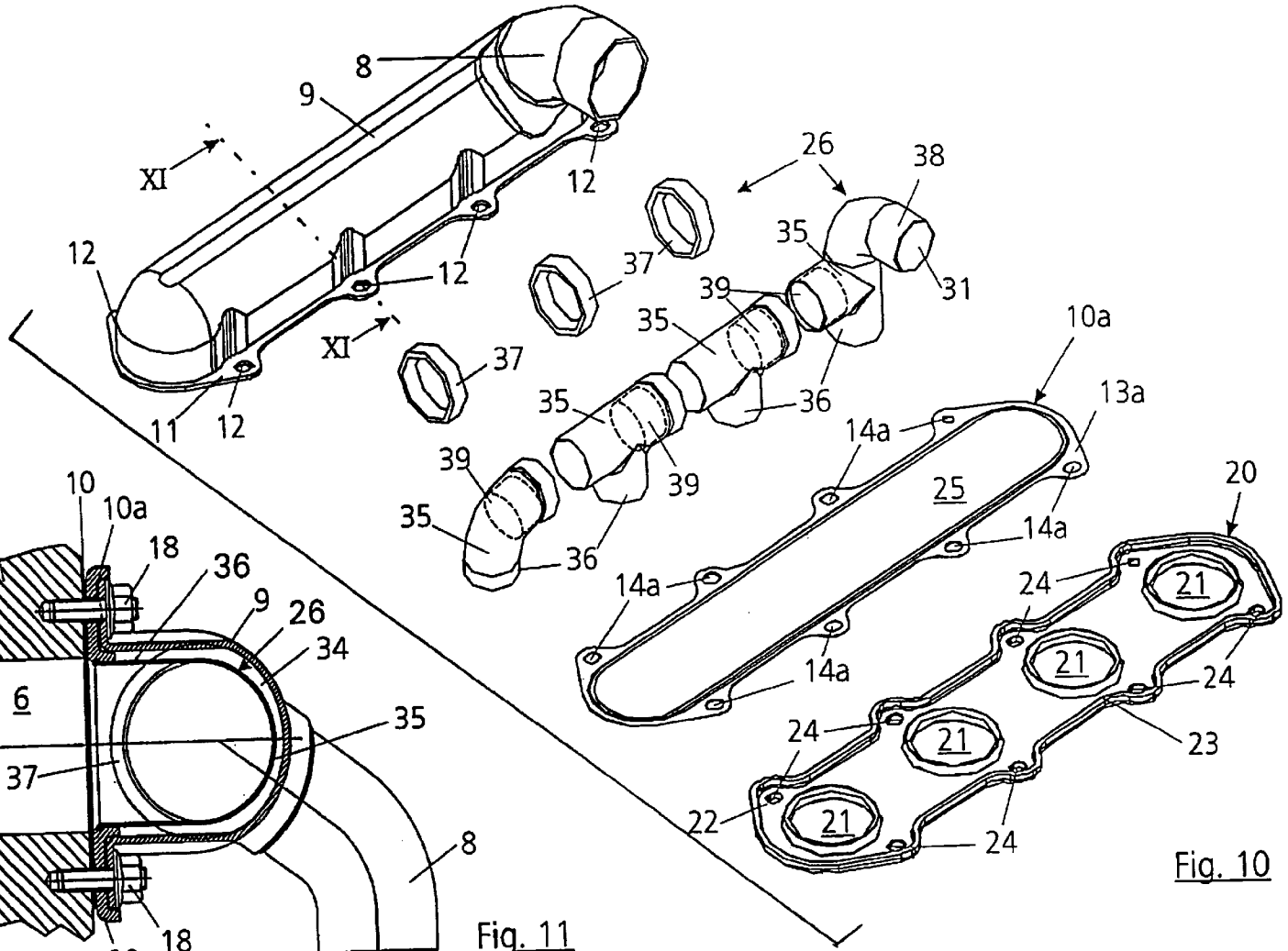
FIG. 10 shows an exploded illustration of the exhaust manifold from FIG. 1 in a fifth embodiment.

FIG. 10 illustrates a further exhaust manifold 1 which is of very similar design to the exhaust manifold 1 illustrated in FIG. 8. The gas-conducting channel 26 is also provided here, but comprises a plurality of individual channels 35 which are designed in each case with connections 36 to the bores 21 in the flange 20, which is also provided here. The bores 21 have a round cross section and the connections 36 are inserted into these bores 21 and optionally welded into place. As an alternative, other forms of the bores 21, for example oval or rectangular, would also be possible in which case the connections 36 would then be adapted to these forms of the bores 21 and appropriate sealing would additionally be undertaken.

At their connecting points, the individual channels 35 are connected to one another by portions, which are provided at in each case one of the ends of the individual channels 35 and in which the next individual channel 35 is inserted and optionally welded. Situated in the exhaust-gas collector housing 9 are retaining rings 37 which bear against the latter and surround the gas-conducting channel 26. The gas-conducting channel 26 is prevented from vibrating by the retaining rings 37, which consist, for example, of a wire knitted fabric.

An outlet 38, having an opening 31, leads away from one of the individual channels 35 through the opening 7 in the exhaust-gas collector housing 9 to the exhaust pipe 8, which is also fitted here to the exhaust-gas collector housing 9.

Figure 11:
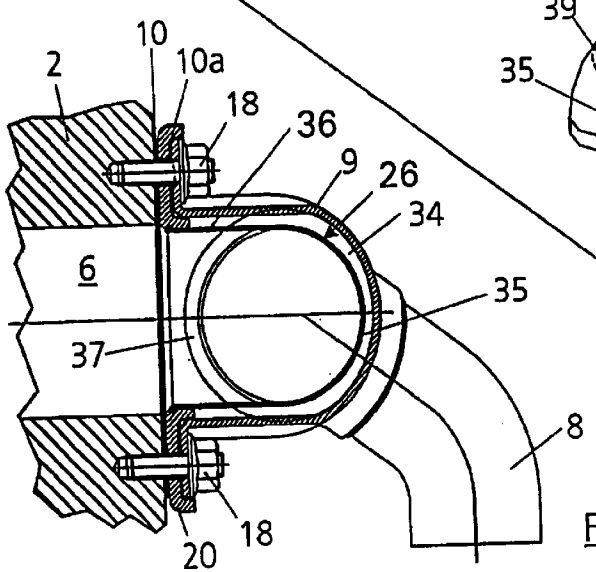
FIG. 11 shows a section according to the line XI—XI from FIG. 10.

In the section according to FIG. 11, it can be seen that, here too, the sealing device 10*a* is used between the exhaust-gas collector housing 9 and the flange 20 and the sealing device 10 is used between the flange 20 and the cylinder head 2. Furthermore, as in the case of the embodiment according to FIGS. 6, 7, 8 and 9, the air gap 34 is situated between the gas-conducting channel 26 and the exhaust-gas collector housing 9. This gas-conducting channel 26 can also consist of a material which has high temperature stability and is permeable for exhaust gases.

Figure 12:
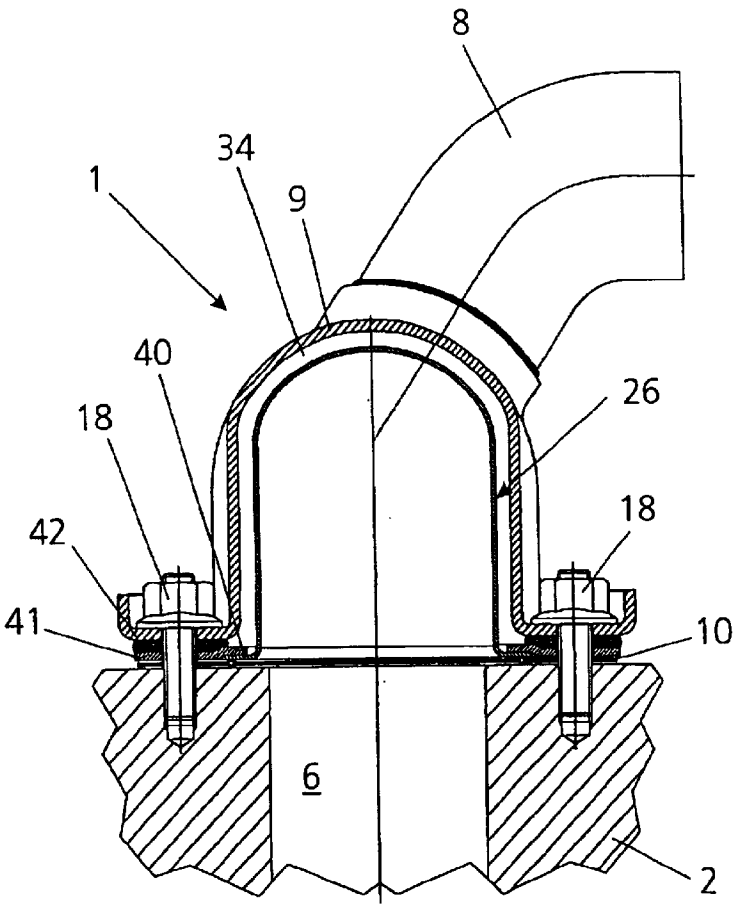
FIG. 12 shows a sectional illustration of the exhaust manifold from FIG. 1 in a sixth embodiment.

FIG. 12 shows a further exhaust manifold 1 which likewise has a gas-conducting channel 26 in its interior. The gas-conducting channel 26 is provided, on its side facing the cylinder head 2, with a circumferential collar 40, which is arranged between the sealing device 10 on its lower side and an additional clamping element 41 on its upper side. The clamping element 41 partially overlaps the collar 40 and covers the latter on its entire circumference. In order to achieve tightness of the exhaust manifold 1, the clamping element 41 is provided, on its side facing the exhaust-gas collector housing 9, with a circumferential sealing layer 42.

The fastening means 18 are, of course, also provided here and, with the aid of the clamping element 41, clamp the gas-conducting channel 26 between the exhaust-gas collector housing 9 and the sealing device 10 or cylinder head 2 with the desired force. The construction mentioned prevents movement of the gas-conducting channel 26 perpendicularly with respect to the plane of the cylinder head 2, but with appropriate tightening of the screws 18 movement of the gas-conducting channel 26, triggered by the effect of heat, in the plane of the cylinder head 2 is still possible.

Figure 13:
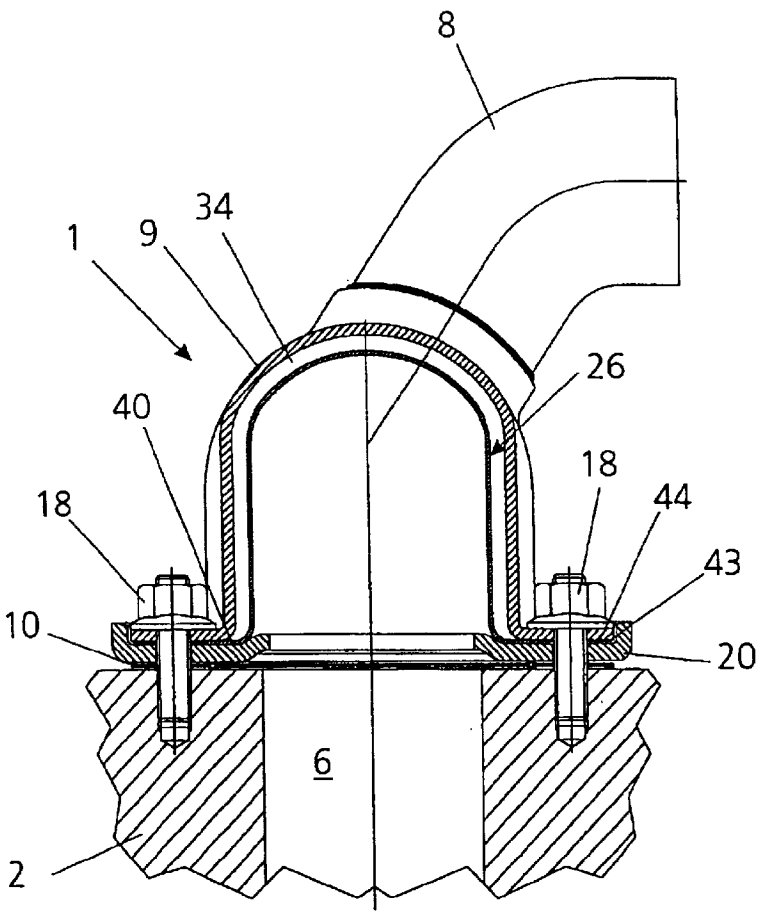
FIG. 13 shows a sectional illustration of the exhaust manifold from FIG. 1 in a seventh embodiment.

The gas-conducting channel 26 is provided with a circumferential collar 40 in the case of the exhaust manifold according to FIG. 13 too. However, said collar is clamped directly between the exhaust-gas collector housing 9 and the flange 20, which is likewise provided in this case, again by means of the fastening means or screws 18. In addition, a circumferential sealing device 43 is provided on the circumference of the collar 40, specifically likewise between the exhaust-gas collector housing 9 and the flange 20. By means of raised portions 44 protruding in the direction of the cylinder head 2 on the sealing device 43 and/or by an appropriate selection of the thickness of the sealing device 43 and corresponding tightening of the screws 18, movement of the gas-conducting channel 26 in the plane of the cylinder head 2 is also possible here, it being possible at the same time to prevent undesirable vibrations of said channel.

What is claimed is:

1. An exhaust manifold for mounting on a cylinder head of an internal combustion engine, said exhaust manifold having at least one cylinder bank which is provided with exhaust-gas bores for discharge of exhaust gas, having an exhaust-gas collector housing for receiving exhaust gas from the cylinder head, having a sealing device arranged between the exhaust-gas collector housing and the cylinder head, the exhaust-gas collector housing being provided with recesses through which the exhaust-gas collector can be connected directly to the cylinder head via fastening means;

wherein the sealing device (10) is designed as a separate part, movements caused by an effect of heat are possible between the exhaust-gas collector housing (9) and the sealing device (10) and between the exhaust-gas collector housing (9) and cylinder head (2);

a gas-conducting channel is arranged within the exhaust-gas collector housing, an air gap is produced between the exhaust-gas collector housing and the gas-conducting channel, and movement caused by the effect of heat are possible between the gas-conduction channel (26) and the sealing device;

a gas-conducting channel (26) is arranged within the exhaust-gas collector housing (9), an air gap (34) is produced between the exhaust-gas collector housing (9) and the gas-conducting channel (26); and the air gap (34) is filled with sound-absorbing material.

2. An exhaust manifold for mounting on a cylinder head of an internal combustion engine, said exhaust manifold having at least one cylinder bank which is provided with exhaust-gas bores for discharge of exhaust gas, having an exhaust-gas collector housing for receiving exhaust gas from the cylinder head, having a sealing device arranged between the exhaust-gas collector housing and the cylinder head, the exhaust-gas collector housing being provided with recesses through which the exhaust-gas collector can be connected directly to the cylinder head via fastening means;

wherein the sealing device (10) is designed as a separate part, movements caused by an effect of heat are possible between the exhaust-gas collector housing (9) and the sealing device (10) and between the exhaust-gas collector housing (9) and cylinder head (2);

a gas-conducting channel is arranged within the exhaust-gas collector housing, an air gap is produced between the exhaust-gas collector housing and the gas-conducting channel, and movement caused by the effect of heat are possible between the gas-conduction channel (26) and the sealing device;

the sealing device (10) runs over an entire region between the exhaust-gas collector housing (9) and the cylinder head (2); and a plurality of individual catalytic converter elements (39) are arranged in the gas-conducting channel (26).

3. An exhaust manifold for mounting on a cylinder head of an internal combustion engine, said exhaust manifold having at least one cylinder bank which is provided with exhaust-gas bores for discharging exhaust gas, having an exhaust-gas collector housing for receiving exhaust gas from the cylinder head, having a sealing device arranged between the exhaust-gas collector housing and the cylinder head, the exhaust-gas collector housing being provided with recesses through which the exhaust-gas collector can be connected directly to the cylinder head via fastening means;

wherein the sealing device (10) is designed as a separate part, movement caused by a heat effect is possible between the exhaust-gas collector housing (9) and the sealing device (10) and between the exhaust-gas collector housing (9) and cylinder head (2);

a gas-conducting channel is arranged within the exhaust-gas collector housing, an air gap is formed between the exhaust-gas collector housing and the gas-conducting channel, and movement caused by a heat effect is possible between the gas-conduction channel and the sealing device;

a flange (20) is arranged between the exhaust-gas collector housing (9) and the cylinder head (2), said flange has recesses (24) which at least approximately correspond with the recesses (12) of the exhaust-gas collector housing (9) and are intended for receiving the fastening means (18) for connecting the exhaust-gas collector housing (9) to the cylinder head (2); and the flange (20) has, on an outer perimeter thereof, a beading (23), an inner contour of which at least approximately corresponds with an outer contour of the collar (11) surrounding the exhaust-gas collector housing (9), and movement caused by a heat effect is possible between the exhaust-gas collector housing (9) and the flange (20).

4. An exhaust manifold for mounting on a cylinder head of an internal combustion engine, said exhaust manifold having at least one cylinder bank which is provided with exhaust-gas bores for discharging exhaust gas, having an exhaust-gas collector housing for receiving exhaust gas from the cylinder head, having a first sealing device arranged between the exhaust-gas collector housing and the cylinder head, the exhaust-gas collector housing being provided with recesses through which the exhaust-gas collector can be connected directly to the cylinder head via fastening means;

wherein the first sealing device (10) is designed as a separate part, movement caused by a heat effect is possible between the exhaust-gas collector housing (9) and the first sealing device (10) and between the exhaust-gas collector housing (9) and cylinder head (2);

a gas-conducting channel is arranged within the exhaust-gas collector housing, an air gap is produced between the exhaust-gas collector housing and the gas-conducting channel, and movement caused by the effect of heat are possible between the gas-conduction channel and the first sealing device;

a flange (20) is arranged between the exhaust-gas collector housing (9) and the cylinder head (2), said flange having recesses (24) which at least approximately correspond with the recesses (12) of the exhaust-gas collector housing (9) which are intended for receiving the fastening means (18) for connecting the exhaust-gas collector housing (9) to the cylinder head (2); and a further sealing device (10*a*) is arranged between the exhaust-gas collector housing (9) and the flange (20).

5. The exhaust manifold as claimed in claim 4, wherein the flange (20) is provided with bores (21) which at least approximately correspond with the exhaust-gas bores (6) of the cylinder head (2).

6. The exhaust manifold as claimed in claim 4, wherein the flange (20) consists of a material with high temperature stability.

7. The exhaust manifold as claimed in claim 4, wherein the first sealing device (10) is arranged between the flange (20) and the cylinder head (2).

8. An exhaust manifold for mounting on a cylinder head of an internal combustion engine, said exhaust manifold having at least one cylinder bank which is provided with exhaust-gas bores for discharge of exhaust gas, having an exhaust-gas collector housing for receiving exhaust gas from the cylinder head, having a sealing device arranged between the exhaust-gas collector housing and the cylinder head, the exhaust-gas collector housing being provided with recesses through which the exhaust-gas collector can be connected directly to the cylinder head via fastening means;

wherein the sealing device (10) is designed as a separate part, movements caused by the effect of heat are possible between the exhaust-gas collector housing (9) and the sealing device (10) and between the exhaust-gas collector housing (9) and cylinder head (2);

a gas-conducting channel is arranged within the exhaust-gas collector housing, an air gap being produced between the exhaust-gas collector housing and the gas-conducting channel, and movement caused by the effect of heat are possible between the gas-conduction channel (26) and the sealing device;

a gas-conducting channel (26) is arranged within the exhaust-gas collector housing (9), an air gap (34) is produced between the exhaust-gas collector housing (9) and the gas-conducting channel (26); and the gas-conducting channel (26) consists of a material which is permeable for fluid.

9. The exhaust manifold as claimed in claim 8, wherein the material of the gas-conducting channel (26), which material is permeable for fluids, is a woven fabric or a perforated plate.

10. An exhaust manifold for mounting on a cylinder head of an internal combustion engine, said exhaust manifold having at least one cylinder bank which is provided with exhaust-gas bores for discharge of exhaust gas, having an exhaust-gas collector housing for receiving exhaust gas from the cylinder head, having a sealing device arranged between the exhaust-gas collector housing and the cylinder head, the exhaust-gas collector housing being provided with recesses through which the exhaust-gas collector can be connected directly to the cylinder head via fastening means;

wherein the sealing device (10) is designed as a separate part, movements caused by an effect of heat are possible between the exhaust-gas collector housing (9) and the sealing device (10) and between the exhaust-gas collector housing (9) and cylinder head (2);

a gas-conducting channel is arranged within the exhaust-gas collector housing, an air gap is produced between the exhaust-gas collector housing and the gas-conducting channel, and movement caused by the effect of heat are possible between the gas-conduction channel (26) and the sealing device;

a gas-conducting channel (26) is arranged within the exhaust-gas collector housing (9), an air gap (34) being produced between the exhaust-gas collector housing (9) and the gas-conducting channel (26); and the gas-conducting channel (26) is provided, on its side facing the cylinder head (2), with a circumferential collar (40) which, in the assembled state, is at least indirectly wedged between the exhaust-gas collector housing (9) and the sealing device (10), movements caused by the effect of heat being possible between the gas-conducting channel (26) and the sealing device (10).

11. The exhaust manifold as claimed in claim 10, wherein the circumferential collar (40) of the gas-conducting channel (26) is arranged displacably between the exhaust-gas collector housing (9) and the flange (20).

12. The exhaust manifold as claimed in claim 11, wherein a sealing device (43) is arranged between the circumferential collar (40) of the gas-conducting channel (26) and the flange (20).

13. An exhaust manifold for mounting on a cylinder head of an internal combustion engine, said exhaust manifold having at least one cylinder bank which is provided with exhaust-gas bores for discharging exhaust gas, having an exhaust-gas collector housing for receiving exhaust gas from the cylinder head, having a sealing device arranged between the exhaust-gas collector housing and the cylinder head, the exhaust-gas collector housing being provided with recesses through which the exhaust-gas collector can be connected directly to the cylinder head via fastening means;

wherein the sealing device (10) is designed as a separate part, movement caused by a heat effect is possible between the exhaust-gas collector housing (9) and the sealing device (10) and between the exhaust-gas collector housing (9) and cylinder head (2);

a gas-conducting channel is arranged within the exhaust-gas collector housing, an air gap is formed between the exhaust-gas collector housing and the gas conducting channel, and movement caused by a heat effect are possible between the gas-conduction channel and the sealing device;

a flange (20) is arranged between the exhaust-gas collector housing (9) and the cylinder head (2), said flange has recesses (24) which at least approximately correspond with the recesses (12) of the exhaust-gas collector housing (9) and are intended for receiving the fastening means (18) for connecting the exhaust-gas collector housing (9) to the cylinder head (2);

a gas-conducting channel (26) is arranged within the exhaust-gas collector housing (9), an air gap (34) is formed between the exhaust-gas collector housing (9) and the gas-conducting channel (26); and a flange (20) is arranged between the gas-conducting channel (26) and the cylinder head (2).

14. The exhaust manifold as claimed in claim 13, wherein the flange (20) consists of a material with high temperature stability.

15. The exhaust manifold as claimed in claim 13, wherein the flange (20) is provided with bores (29) which at least approximately correspond with the exhaust-gas bores (6) of the cylinder head (2).

16. The exhaust manifold as claimed in claim 15, wherein a diameter of the bores (29) in the flange (20), in a longitudinal direction of the flange (20), is larger than a diameter of the bores (29) in a transverse direction of the flange (20).

* * * * *